US010124383B2

(12) United States Patent
Yamamoto

(10) Patent No.: US 10,124,383 B2
(45) Date of Patent: Nov. 13, 2018

(54) EXTRUSION METHOD FOR EXTRUDED MATERIAL

(71) Applicant: Ube Machinery Corporation, Ltd., Ube (JP)

(72) Inventor: Takeharu Yamamoto, Ube (JP)

(73) Assignee: Ube Machinery Corporation, Ltd. (JP)

( * ) Notice: Subject to any disclaimer, the term of this patent is extended or adjusted under 35 U.S.C. 154(b) by 15 days.

(21) Appl. No.: 15/128,228

(22) PCT Filed: Mar. 25, 2015

(86) PCT No.: PCT/JP2015/059183
§ 371 (c)(1),
(2) Date: Sep. 22, 2016

(87) PCT Pub. No.: WO2015/147075
PCT Pub. Date: Oct. 1, 2015

(65) Prior Publication Data

US 2017/0100758 A1 Apr. 13, 2017

(30) Foreign Application Priority Data

Mar. 26, 2014 (JP) ..... 2014-063170
Jul. 1, 2014 (JP) ..... 2014-135902

(51) Int. Cl.
*B21C 35/04* (2006.01)
*B21C 23/21* (2006.01)
*B21C 23/08* (2006.01)

(52) U.S. Cl.
CPC ..... *B21C 35/04* (2013.01); *B21C 23/085* (2013.01); *B21C 23/214* (2013.01); *B21C 23/217* (2013.01)

(58) Field of Classification Search
CPC ..... B21C 23/04; B21C 23/08; B21C 23/085; B21C 23/212; B21C 23/214; B21C 23/217; B21C 23/218; B21C 35/04
See application file for complete search history.

(56) References Cited

U.S. PATENT DOCUMENTS 4,056,964 A 11/1977 Shibasaki et al.
6,389,863 B1 5/2002 Ziemons et al.

FOREIGN PATENT DOCUMENTS

JP 58-166915 U 11/1983
JP 5-9709 U 2/1993
JP 10-5852 A 1/1998
JP 10-244315 A 9/1998
JP 11-47823 A 2/1999
JP 2000-126813 A 5/2000
JP 2001-179528 A 7/2001
JP 2006-68750 A 3/2006

*Primary Examiner* — Teresa M Ekiert
(74) *Attorney, Agent, or Firm* — DLA Piper LLP (US)

(57) ABSTRACT

An extrusion method using an extrusion press including an end platen to which a pressure ring is provided, a die, a container, a drive part for movement of the container, and a main cylinder device having an extrusion stem to form a billet into a shape includes extruding the billet loaded in the container by the extrusion stem from the die to shape it to an extruded material, releasing sealing pressure from the die, cutting the billet between the die and the container and between the die and the pressure ring by moving the die, and resuming shaping of extruded materials by the billet remaining inside the container.

12 Claims, 10 Drawing Sheets

EXTRUSION METHOD FOR EXTRUDED MATERIAL

TECHNICAL FIELD

The present invention relates to a method for extruding a billet of a ferrous metal or nonferrous metal from a die to form it into a shape.

BACKGROUND ART

In general, when extruding a metal material, for example, a billet of aluminum or an alloy material of the same, by an extrusion press apparatus, the following is performed. An extrusion stem is attached to a front end part of a main ram driven by a hydraulic cylinder. First, in a state with a container pushed against a die, the billet is placed in the container by the extrusion stem etc. Further, a main ram is made to further advance by a drive operation of the hydraulic cylinder. Due to this, the billet is pushed by the extrusion stem. Therefore, a shaped product (extruded material) is extruded from an outlet part of the die.

In the past, when producing a plurality of types of extruded products, the general practice was to finish extruding a single billet inside the container up to its end, exchange the die, then resume extrusion. Further, in the case of a short extruded product, the general practice was to heat a short billet corresponding to the length of the extruded product by a heater and repeatedly alternately exchange the die and perform extrusion. According to PLT 1, the following invention is disclosed. This invention is an extrusion method for an aluminum shape, wherein an aluminum billet is loaded in a container and pressure is applied by a stem to the aluminum billet to extrude it from the die. With this method, when a predetermined length of the aluminum shape is extruded, the container and the stem are made to retract from the die and the aluminum billet is broken between the die and the container. After that, the parts of the aluminum material sticking out from the die and container are cut off by shear knives. Further, the die is exchanged and the billet remaining inside the container is used to resume extrusion.

CITATION LIST

Patent Literature

PLT 1: Japanese Unexamined Patent Publication No. 2006-068750A

SUMMARY OF INVENTION

Technical Problem

The conventional extrusion method for aluminum shapes was a method for extruding one or more billets by a single die. The practice had been to cut an approximately 20 to 50 meter long shape extruded from a single billet to several dozen constant spans. With this extrusion method, for example it was difficult to handle orders for single or small number of shapes in short run production. If trying to handle such orders, it may be considered to shorten the length of the billet. However, a short billet tends to be overheated in a furnace. To avoid this, the heating program has to be changed. Further, even if doing this, the temperature of the furnace becomes unstable etc. resulting in a vicious cycle. In the end, often the entire amount of one billet was extruded and the unnecessary parts of the extruded material were used as scrap materials for remelting.

Next, if shortening one billet, since the length of the discard (remaining part after extrusion, scrap part) is the same, if comparing a short billet with a long billet, the ratio of discard for one billet becomes larger and the yield becomes poor. Further, if the length of the billet becomes shorter than its diameter, the billet will easily fall over and the handling of billet will no longer be easy.

In the invention of Cited Reference 1, the aluminum billet is broken or fractured between the die and container, then the parts of the aluminum material sticking out from the die and container are cut off by shear knives. Therefore, the container and extrusion stem retract from the die in a long stroke enabling entry of the shear devices becomes necessary. Due to this, time is taken and the productivity becomes poorer. Next, to cut off parts of the aluminum billet, a die side shear knife and a container side shear knife are used to cut them off, then the die slide is moved to cut the products. For this reason, the aluminum billet remaining in the die ends up becoming scrap. That is, the yield ratio becomes poor. Furthermore, the aluminum billet is fractured between the die and container, so the fracture surfaces become distorted. Even if cut off by a shear knife, the back surface of the billet does not become sufficiently flat. As a result, air etc. may be entrained and blister-like shape may be formed at the next product. Further, since a shear knife is used for cutting off parts, the shear knife also reaches the end of its service life and therefore is exchanged more frequently. For this reason, the productivity becomes poorer. PLT 1 describes to press and crush the aluminum material sticking out from the container side and exchange the die with the next one, but the billet in the container is formed in work-hardening, so does not easily become compressed. Therefore, blister-like shape may be formed in the next product.

Solution to Problem

The present invention is mainly classified into the following methods: In the first to fourth methods, a billet is cut between the die and container and between the die and pressure ring. The second to fourth methods respectively handle extrusion for N lots per single billet (second), handle the case where the extruded material leaks out from the space between the die and container to the outside (so-called blooming phenomenon) (third), and handle the case of the extruded material sticking in the die (fourth). In the fifth to eighth methods, the billet is cut between the die ring and container and between the die ring and a bolster. The sixth to eighth methods respectively handle extrusion for N lots per single billet (sixth), handle the case where the extruded material leaks out from the space between the die ring and container to the outside (so-called "blooming phenomenon") (seventh), and handle the case of the extruded material sticking in the die (eighth).

The second method of the present invention is a method in an extrusion press provided with a moving means for the container and using a main cylinder device to extrude a billet loaded in the container from a die by an extrusion stem so as to form a shape wherein when a predetermined length of extruded material is extruded, it releases the sealing pressure and cuts the billet between the die and container and between the die and pressure ring. After that, it exchanges the die and resumes the extrusion by the part of the billet remaining inside the container. The first and fifth methods do not include exchanging the die.

The third method of the present invention is a method in an extrusion press provided with a moving means for the container and using a main cylinder device to extrude a billet loaded in the container from a die by an extrusion stem so as to form a shape, wherein when the extruded material leaks from the space between the die and container to the outside, it releases the sealing pressure from the die, cuts the billet between the die and container and between the die and pressure ring, then resumes the extrusion by the part of the billet remained inside the container.

The fourth method of the present invention is a method in an extrusion press provided with a moving means for the container and using a main cylinder device to extrude a billet loaded in the container from a die by an extrusion stem so as to form a shape, wherein when the extruded material sticks in the die, it releases the sealing pressure from the die, cuts the billet between the die and container and between the die and pressure ring, then resumes the extrusion by the part of the billet remained inside the container.

In the first to fourth methods of the present invention, the sealing pressure is released from the die, the billet is cut between the die and container and between the die and pressure ring, and the die is exchanged or the same die is used to resume extrusion by the billet remained inside the container. In the conventional method, the broken billet was cut by shear knives, but in the present invention, this operation becomes unnecessary and therefore the time can be shortened.

A sixth method of the present invention is a method in an extrusion press provided with a moving means for the container and using a main cylinder device to extrude a billet loaded in the container from a die by an extrusion stem so as to form a shape wherein when a predetermined length of the extruded material is extruded, it releases the sealing pressure from the die, cuts the billet between the die ring and container and between the die ring and bolster, then exchanges the die and resumes the extrusion by the part of the billet remained inside the container.

A seventh method of the present invention is a method in an extrusion press provided with a moving means for the container and using a main cylinder device to extrude a billet loaded in the container from a die by an extrusion stem so as to form a shape, wherein when extruded material leaks from the space between the die and container to the outside, it releases the sealing pressure from the die, cuts the billet between the die ring and container and between the die ring and bolster, and resumes the extrusion by the part of the billet remained inside the container.

An eighth method of the present invention is a method in an extrusion press provided with a moving means for the container and using a main cylinder device to extrude a billet loaded in the container from a die by an extrusion stem so as to form a shape, wherein when the extruded material sticks in the die, it releases the sealing pressure from the die, cuts the extruded billet between the die ring and container and between the die ring and the bolster, then resumes the extrusion by the part of the billet remained inside the container.

In the fifth to eighth methods of the present invention, the sealing pressure is released from the die, the billet is cut between the die ring and container and between the die ring and bolster, and the die is exchanged or the same die is used to resume extrusion by the billet remained inside the container. A "billet" is used including not only the material before extrusion, but also extrusion material in the middle of being shaped or after being shaped. In the conventional method, the broken billet was cut by shear knives, but in the present invention, this operation becomes unnecessary and therefore the time can be shortened.

When releasing the sealing pressure from the die and cutting the billet between the die and container, the space between the container and die can be positioned.

When cutting the billet, a forced guiding device is attached to an upper guide of the container so that the center of the container does not change.

When cutting the billet, a swingable shear knife is attached to a die cassette so as to contact a container sealing surface, and extrusion material deposited on the container sealing surface is removed.

Advantageous Effects of Invention (1) In the prior art, the billet was broken between the die and container after making the container retract, then the parts of the extruded material sticking out from the die and container were cut off by shear knives. Therefore, a long stroke was required for making the container and extrusion stem retract from the die. As opposed to this, the present invention is not configured to use shear knives for cutting, but just cuts the billet by the die or die ring, so the time is shortened and the productivity is improved.

(2) In the prior art, to cut off the billet, a die side shear knife and a container side shear knife were used to cut off parts and the die cassette was moved, so the part of the billet remained inside the die slide ended up becoming scrap. As opposed to this, in the present invention, only an amount of the length of the die ring becomes scrap, so the yield ratio is improved. Furthermore, there is no end material of the aluminum material, so separation of the die ring and bolster is easy and die handling is easy.

(3) In the prior art, the billet was broken or separated between the die and the container by making the container retract, so the fracture surfaces became distorted and even if parts were cut off by the shear knives, the billet did not become sufficiently flat. As a result, there was the possibility of blister-like shape forming at the next product. As opposed to this, in the present invention, the cut surfaces are clean, no blister-like form, and the quality is improved.

(4) In the prior art, the extruded material sticking out from the container side was pressed and compressed and the next die was exchanged with. At this time, the billet inside the container is formed in a state of work hardening, so does not easily become flat, so there was the possibility of blister-like shape forming at the next product. As opposed to this, in the present invention, the cut surfaces are clean, no blister-like form, and the quality is improved.

(5) In the present invention, the main shear which was attached in prior art for cutting the billet between the die and the container becomes unnecessary, so the cost of the installation members is reduced and simultaneously the facility becomes lower in height and space is saved. Further, the cycle time becomes shorter and maintenance is no longer required.

BRIEF DESCRIPTION OF DRAWINGS

FIG. 2(*a*) is a side cross-sectional view at the time of interrupting extrusion before cutting the billet and FIG. 2(*b*) is a side cross-sectional view when the die rises and cuts the billet.

FIG. 3(*a*) is a side cross-sectional view of the time when interrupting extrusion before cutting the billet. FIG. 3(*b*) is a side cross-sectional view of the time when the die ring rises and cuts the billet.

FIG. 4(*a*) is a plan view of a die cutting block (in the present embodiment, 36) rising together with the die in the first embodiment of the case of cutting by the die as a whole. FIG. 4(*b*) is a plan view of a die ring cutting block (in the present embodiment, 37) rising together with the die ring in the second embodiment of the case of cutting by only the die ring 29. FIG. 4(*c*) is a front view showing a die slide 38 etc. used for die exchange in FIG. 4(*a*) or FIG. 4(*b*). FIG. 4(*d*) is a front view of a die cassette 35 in the case of cutting in the direction of movement of the die slide 38 in FIG. 4(*c*).

FIG. 5(*a*) is a side cross-sectional view of a die cutting device, while FIG. 5(*b*) is a front cross-sectional view of a container core holding device.

FIGS. 9(*a*) to 9(*f*) are plan cross-sectional views seen from above. FIG. 9(*b*) includes being seen from side.

DESCRIPTION OF EMBODIMENTS

Figure 1:
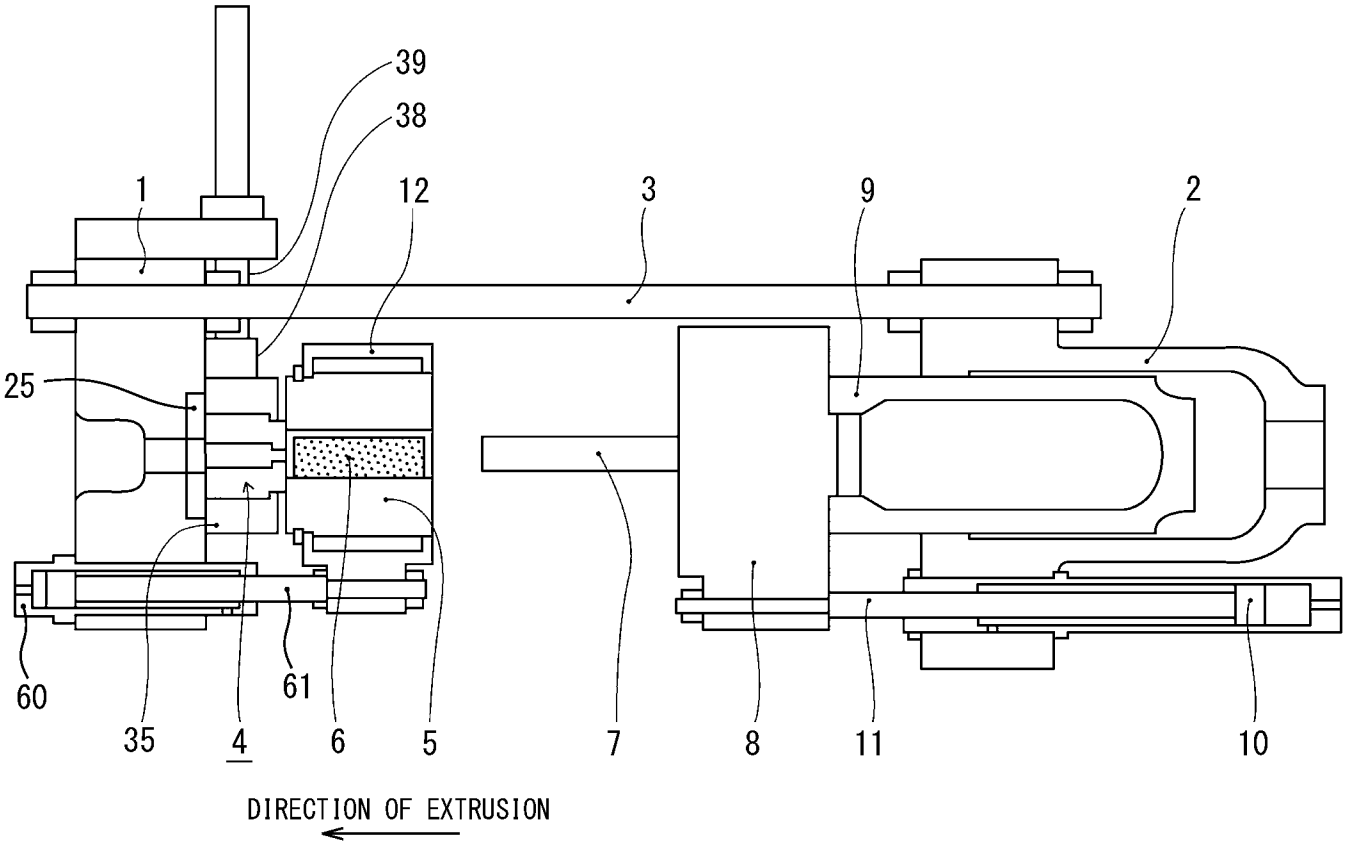
FIG. 1 is an overall schematic side view of an extrusion press of the present invention.

Embodiments of the method for extruding a billet from a die to form it into a shape in an extrusion press according to the present invention will be explained below in detail while referring to the drawings using a ferrous metal or aluminum among nonferrous metals as examples.

First, the extrusion press of the present invention will be explained in brief using FIG. 1. An end platen 1 side is made the front and a main cylinder 2 side is made the rear. As shown in FIG. 1, the extrusion press used in the present invention has an end plate 1 and a main cylinder 2 arranged facing each other and connects the two by a plurality of tie rods 3. At the inside surface of the end platen 1 (surface at rear side), a container 5 is arranged facing a die 4 formed with extrusion holes. Inside the container 5, a billet 6 is loaded. By pushing this toward the die 4, an extruded material 14 having a cross-section corresponding to the holes is extruded. At the end platen 1, a pressure ring 25 receiving pushing force from the die 4 is attached. The container 5 is moved by the moving means comprised of a container movement drive part (cylinder rods 15, 61, etc. in FIG. 6).

The main cylinder 2 generating the extrusion force houses a main ram 9. This can be pressed and moved toward the container 5. At the front end part of this main ram 9, an extrusion stem 7 is attached to the main crosshead 8 in a state sticking out toward the container 5 so as to be arranged coaxially with a billet loading hole of the container 5. At the front end of the extrusion stem 7, a dummy block (not shown) is attached in close contact. Therefore, if driving the main cylinder 2 to make the main crosshead 8 advance, the extrusion stem 7 is inserted into the billet loading hole of the container 5. The extrusion stem 7 presses against the back end face of the loaded billet 6 to extrude the extruded material. The extrusion press apparatus of the present invention comprises the end platen 1, die 4, container 5, drive part for movement of the container, main cylinder 2 having the extrusion stem 7, etc.

At the main cylinder 2, a plurality of side cylinders 10 are arranged parallel to the center of the axis of the extrusion. Their cylinder rods 11 are connected with the main crosshead 8. Due to this, as a preparatory step of the extrusion step, the extrusion stem 7 is initially made to move until the front end of the billet 6 abuts against the die 4. The operation for pressing and extrusion is performed using both the main cylinder 2 and the side cylinders 10.

First Embodiment

Figure 2B:
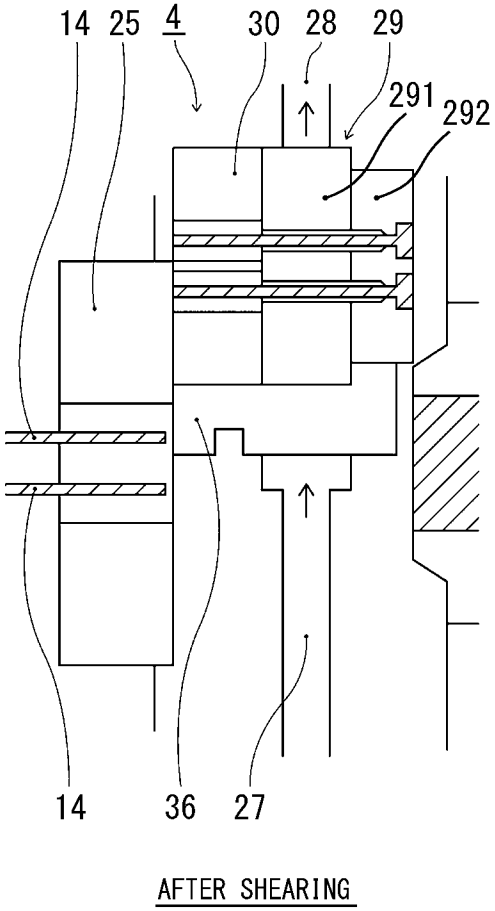
FIGS. 2(*a*) and 2(*b*) are detailed side cross-sectional views of billet cutting in the present invention. They show a first embodiment of a case of cutting by the die 4 as a whole.
Figure 2A:
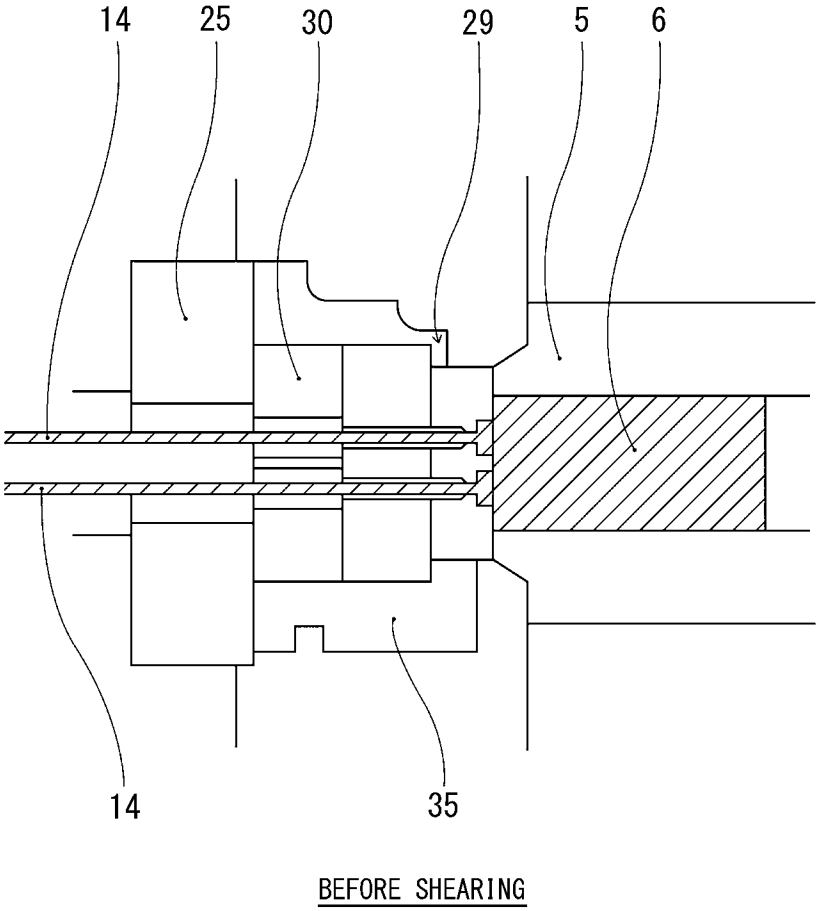

FIGS. 2(*a*) and 2(*b*) are views explaining cutting by the die 4 as a whole in the present invention. The die 4 is comprised of a die ring 29 and a bolster 30. The die 4 of FIGS. 2(*a*) and 2(*b*) is for the case of extruding multiple extruded materials 14. The die ring 29 is comprised of a backer 291 and a die 292. The die cutting cylinder 27 and support 28 sandwich and fasten the die 4. By driving the die cutting cylinder 27, the die 4 moves vertically. In the case of FIGS. 2(*a*) and 2(*b*), the die 4 moves vertically, but it may also move horizontally due to the die slide cylinder rod 39 like in FIG. 4(*d*). In normal extrusion, after a predetermined length is extruded, the extrusion is ended or interrupted and the sealing pressure is released from the die 4. The die cutting cylinder 27 is driven to simultaneously make the die ring 29 and bolster 30 rise. At this time, the billet material is simultaneously cut (sheared) between the container 5 and die 4 and between the pressure ring 25 and die 4. Due to this, the billet 6 is cut by the shearing force. In FIG. 2, the die 4 is designed to move vertically, but it may also move horizontally due to the die slide cylinder 39. When the billet 6 finishes being cut, the extrusion is resumed or the die 4 is exchanged. If the die cassette 35 moves horizontally and the die 4 is exchanged, there is no need to return to the original center of the extrusion press. If the die 4 is not exchanged, the die cassette 35 returns to the original center of the extrusion press.

Second Embodiment

Figure 3B:
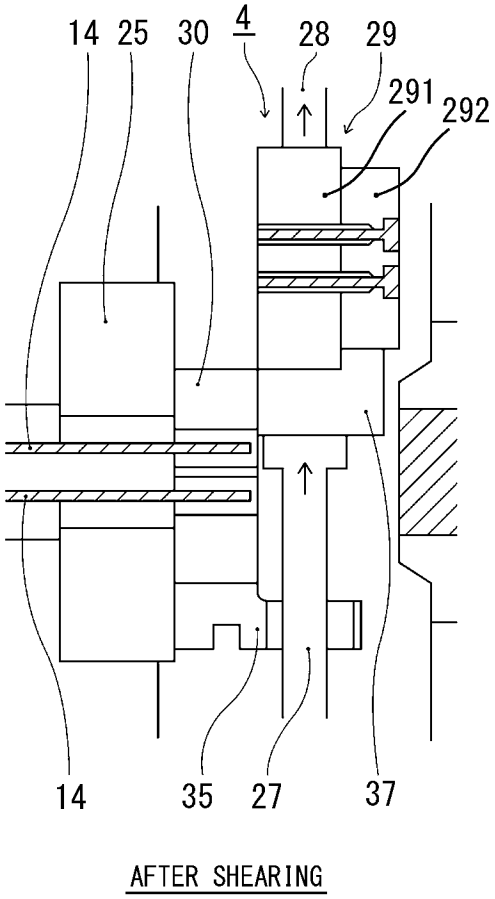
FIGS. 3(*a*) and 3(*b*) are detailed side cross-sectional views of billet cutting in the present invention. They show a second embodiment of a case of cutting by the die ring 29 as a whole.
Figure 3A:
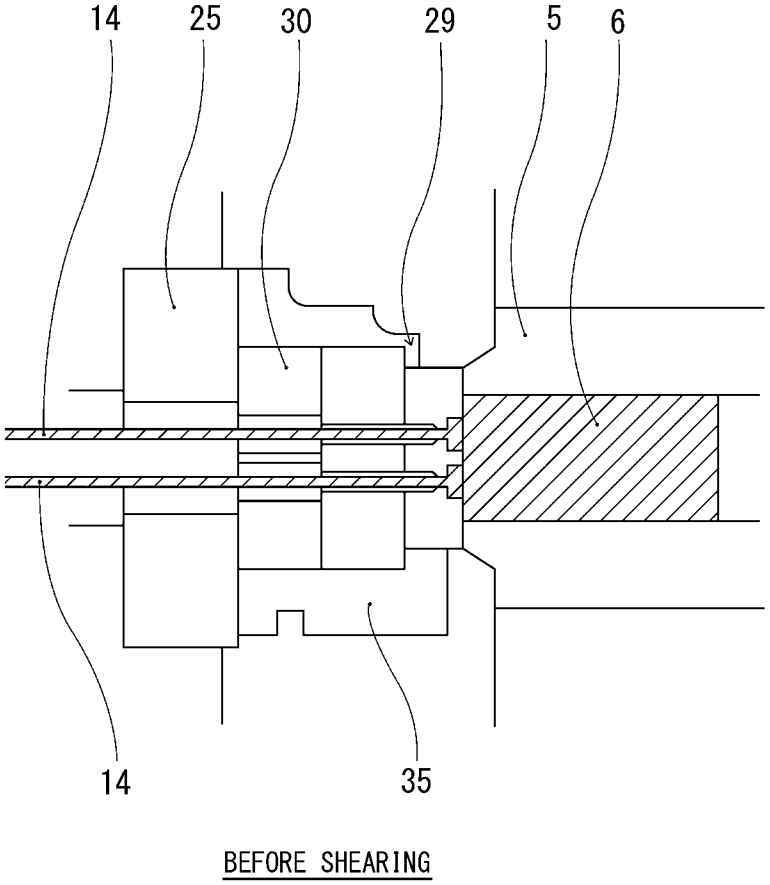

FIGS. 3(*a*) and 3(*b*) are views for explaining cutting of the billet 6 by the die ring 29 of the present invention. The die 4 is comprised of a die ring 29 and a bolster 30. The die cutting cylinder 27 and support 28 sandwich and fasten the die ring 29. By driving the die cutting cylinder 27, the die ring 29 moves vertically. In normal extrusion, after a predetermined length is extruded, the extrusion is ended or interrupted and the sealing pressure is released from the die 4. As shown in FIG. 3(*b*), the die cutting cylinder 27 is driven to make only the die ring 29 rise. At this time, the billet material is simultaneously cut between the container 5 and die ring 29 and between the bolster 30 and die ring 29.

Due to this, the billet 6 is cut by the shear force. When the billet 6 finishes being cut, the extrusion is resumed or the die 4 is replaced.

Figure 4:
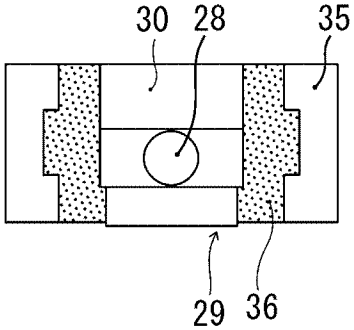
FIGS. 4(*a*) to 4(*d*) are detailed views of the die of the present invention.
Figure 4:
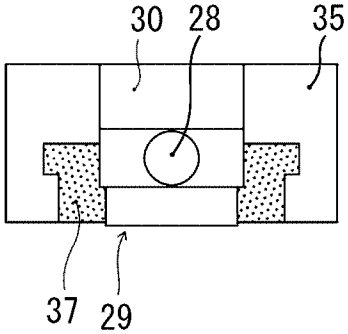
Figure 4:
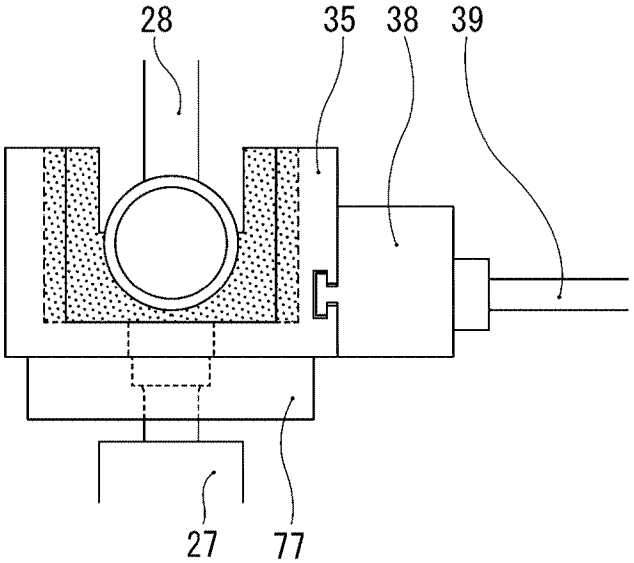
Figure 4:
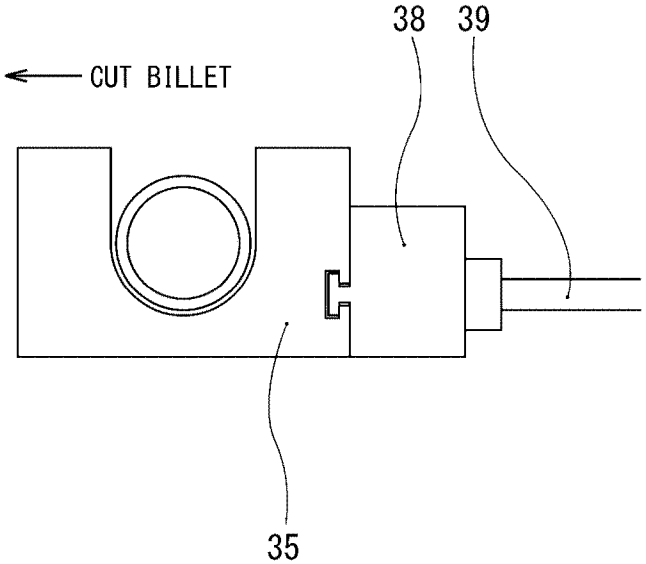

FIG. 4(*a*) shows the die cutting block 36 of the first embodiment for the case of cutting by the die as a whole. This corresponds to FIG. 2(*b*). FIG. 4(*b*) is a view of the cutting block 37 of the second embodiment in the case of cutting by only the die ring 29. This corresponds to FIG. 3(*b*). When cutting the billet 6, the die cutting cylinder 27 is driven and the regions of the member shown by hatchings in FIG. 4(*a*) and FIG. 4(*b*) are respectively simultaneously lifted upward to cut the billet 6. The die cutting blocks 36, 37 move up and down by the die cutting cylinder 27 from the die cassette 35. Further, in FIG. 4(*d*), the die slide 38 is driven by the die slide cylinder rod 39 at the time of exchange of the die or when the die 4 moves horizontally and cuts the billet 6. At the time of exchanging a die, the die 4 is unloaded to the outside of the extrusion press.

Figure 5B:
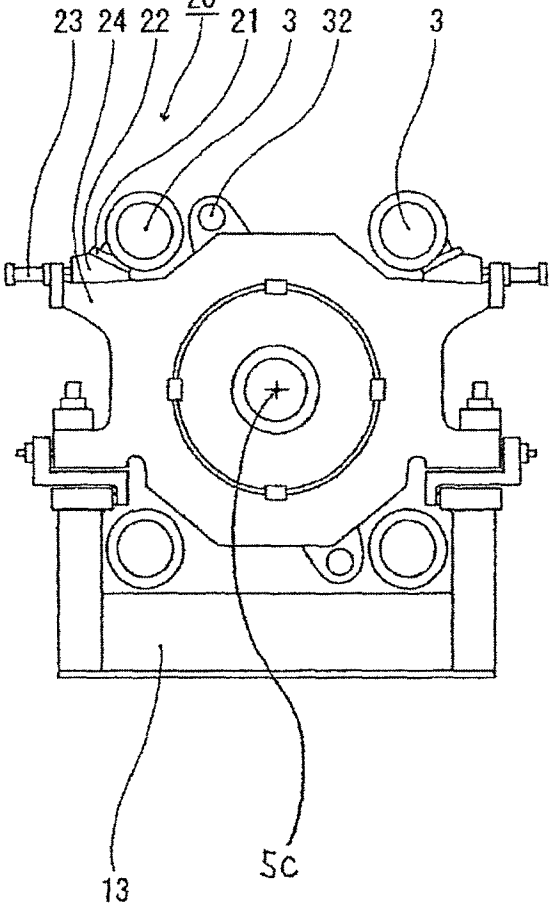
FIGS. 5(*a*) and 5(*b*) are views of an end platen, die, and container in the present invention.
Figure 5A:
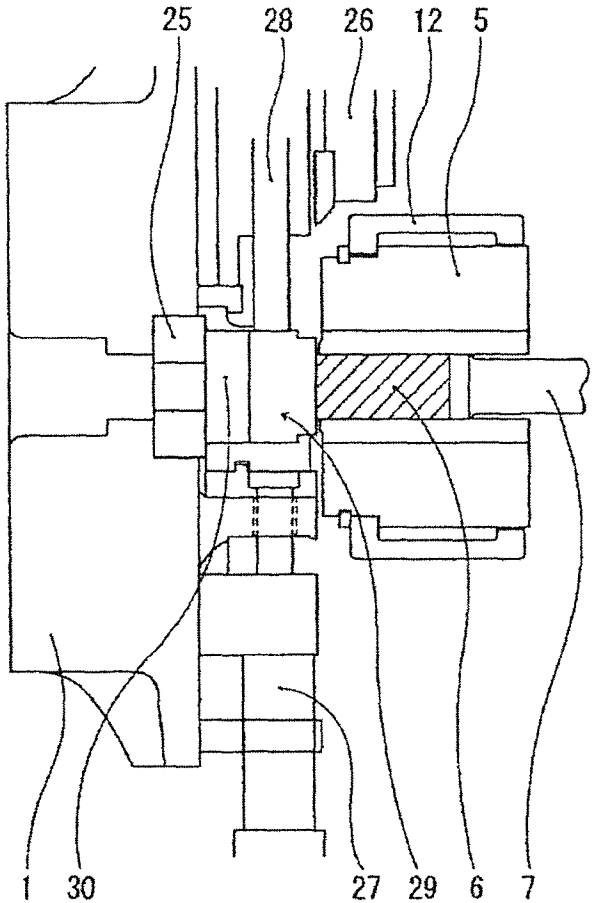

FIG. 5(*b*) is a view of a container core holding device 20 of the present invention. The core holding device 20 is attached at the position of each of the two tie rods 3 above the extrusion press. A taper seat 21 is attached to each tie rod 3. On the other hand, at the upper guide 24 of the container 5, a hydraulic cylinder 23 is attached. At the rod of the hydraulic cylinder 23, a taper block 22 is attached. By driving this taper block 22 by the hydraulic cylinder 23, the taper block 22 and taper seat 21 closely contact each other. By pushing against each other, even if the die cutting cylinder 27 wants to push the die 4 upward or even if it wants to move it in the horizontal direction, a holding force acts on the container 5. Due to this, the core 5*c* of the container 5 will not deviate. Reference numeral 26 shows the main shear of the discard cutting device.

Figure 6:
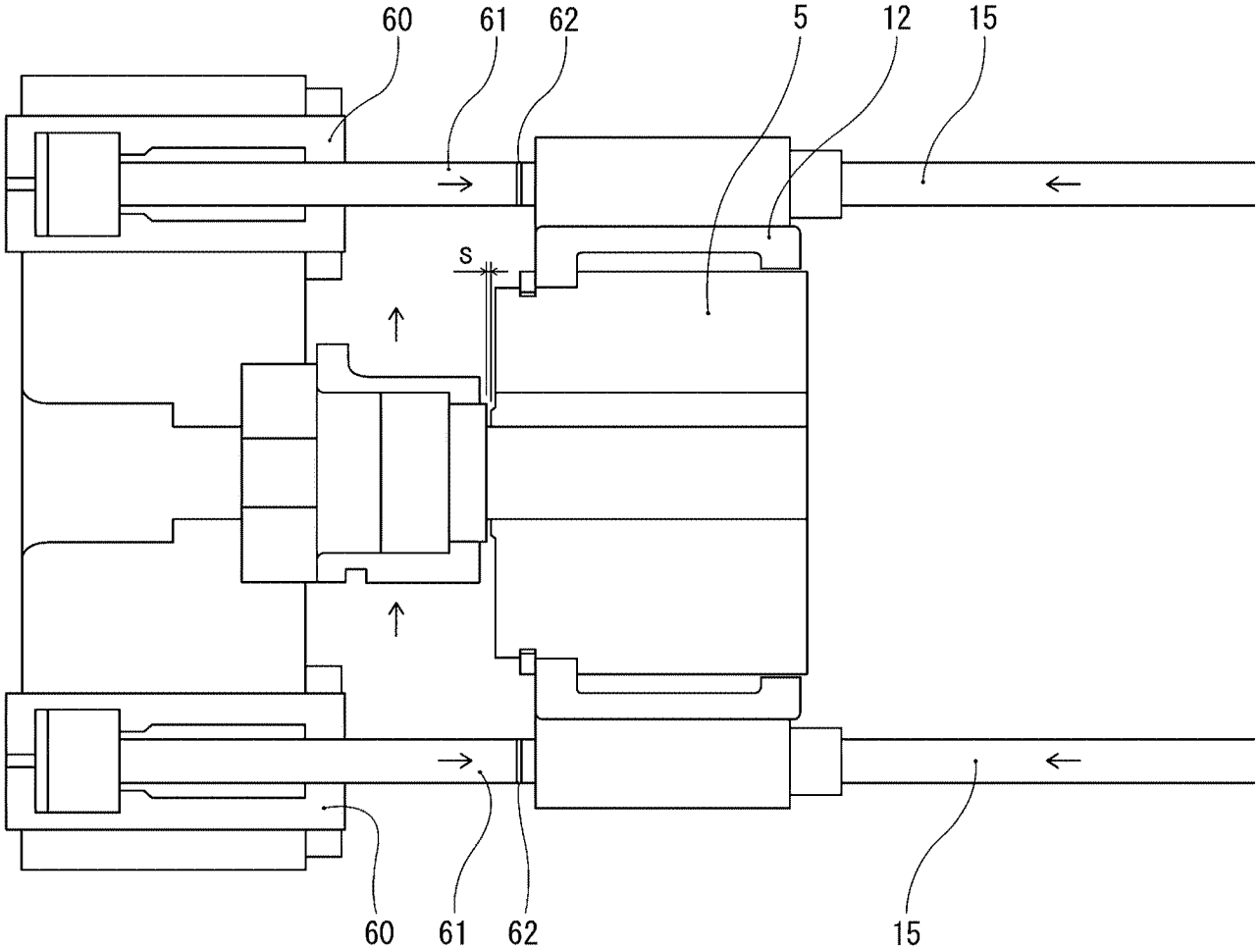
FIG. 6 is an explanatory view for explaining a space positioning device between a container and die in the present invention.

FIG. 6 is a view of a space positioning device between a container and die in the present invention. Each cylinder rod 61 of the hydraulic cylinder 60 attached to the end platen 1 has a shim 62 bolted to it. The cylinder rod 61 is designed to push against the container holder 12. At the limit of advance of the cylinder 60, the space between the container and die is adjusted by the shim 62 to become S. This space S is set so that metal sticking does not occur when cutting the billet. Note that this position of the hydraulic cylinder 60 is the position shown by the notation 32 of FIG. 5(*b*) and includes two locations.

Figure 7:
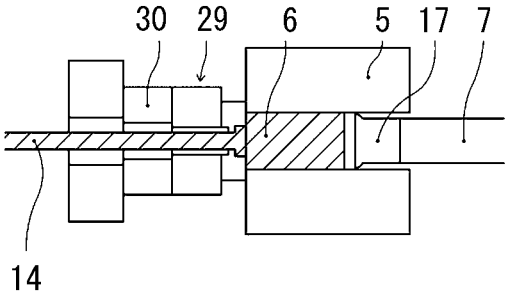
FIGS. 7(*a*) to 7(*f*) are explanatory views of the flow of operation at the time of cutting by a die ring of FIG. 3(*b*) of the present invention.
Figure 7:
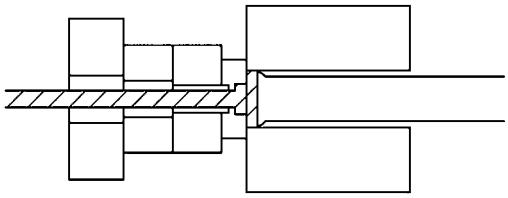
Figure 7:
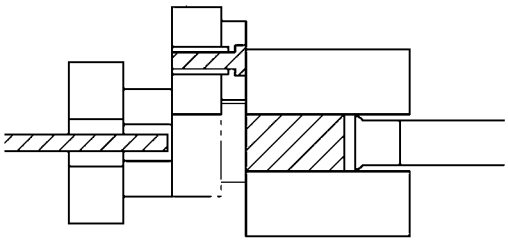
Figure 7:
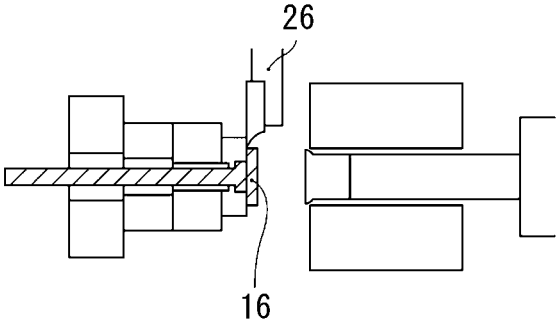
Figure 7:
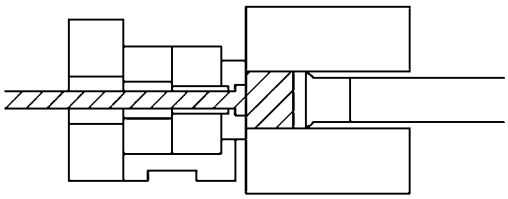
Figure 7:
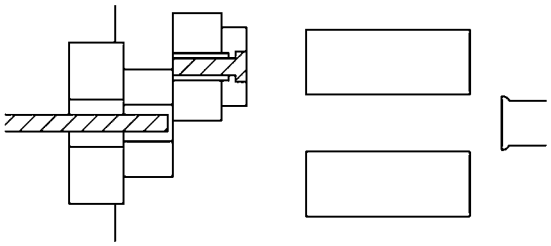
Figure 8A:
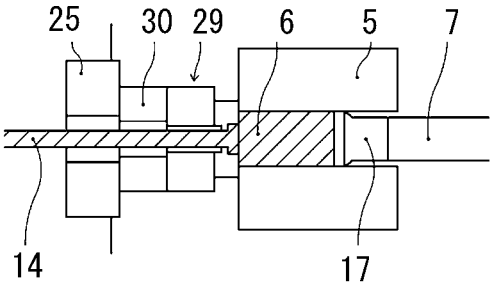
FIGS. 8(*a*) to 8(*f*) are explanatory views of the flow of operation combining the method of making the die ring move to cut the billet in the present invention and the method of removing the discard without using a main shear.
Figure 8D:
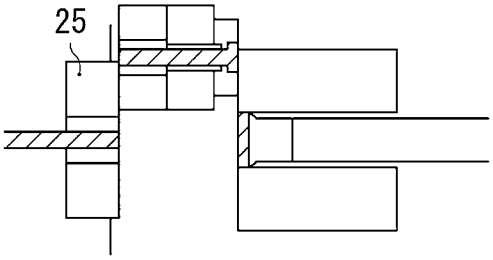
Figure 8B:
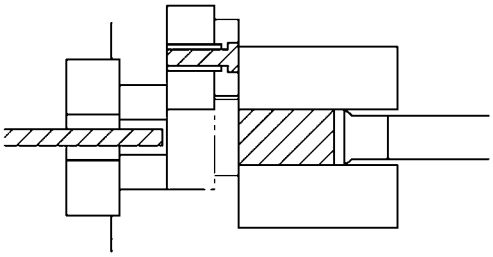
Figure 8E:
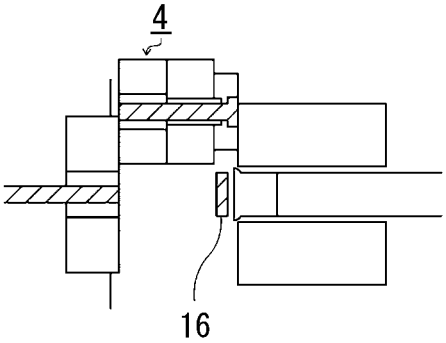
Figure 8C:
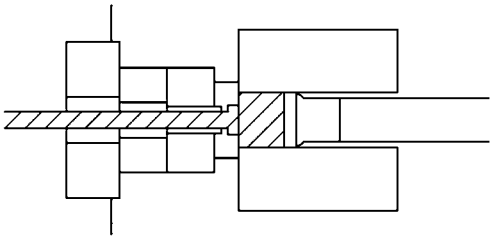
Figure 8F:
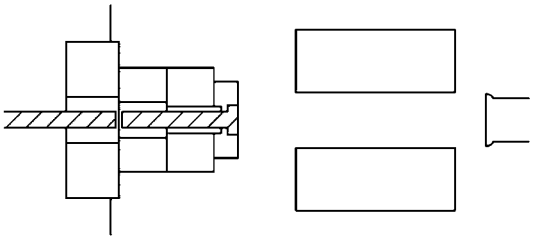
Figure 9A:
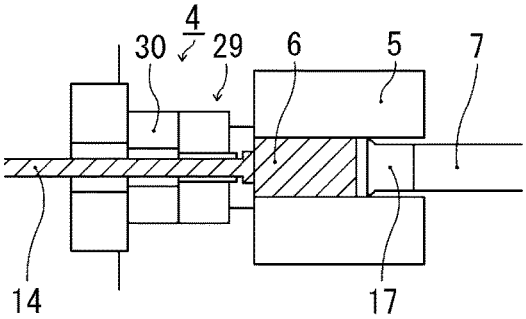
FIGS. 9(*a*) to 9(*f*) are explanatory views of the flow of operation combining the method of making the die of FIG. 2(*b*) move to cut the billet in the present invention and the method of removing the discard without using a main shear.
Figure 9D:
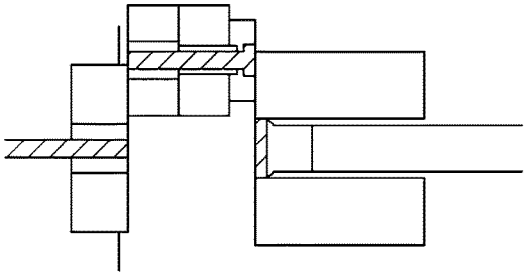
Figure 9B:
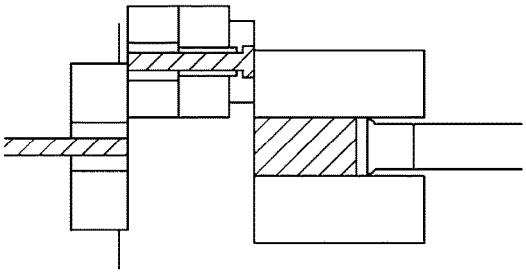
Figure 9E:
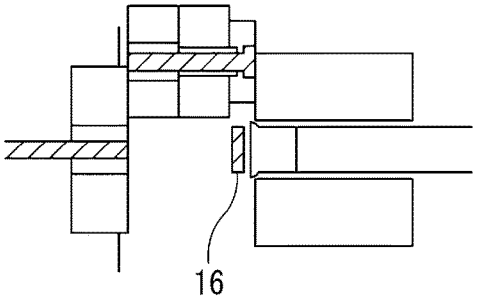
Figure 9C:
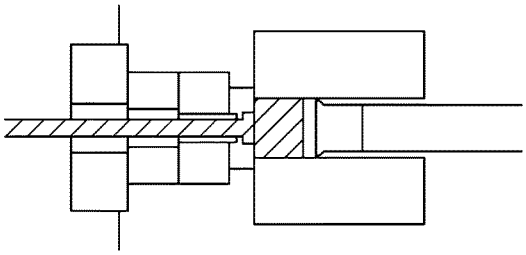
Figure 9F:
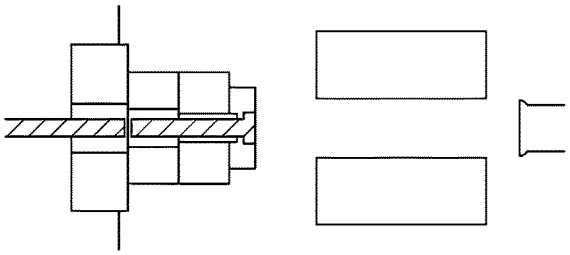

FIGS. 7(*a*) to 7(*f*) show the flow of operation in the case of cutting using a die ring 29 of the present invention.

(a) A certain length of extruded material is extruded, then the extrusion is ended or interrupted to release the sealing pressure from the die 4.
(b) The die ring 29 is moved vertically to thereby simultaneously cut the billet 6 between the container 5 and die ring 29 and between the bolster 30 and the die ring 29.
(c) The extrusion is resumed.
(d) One billet 6 finishes being extruded.
(e) The main shear 26 descends to cut off the discard 16.
(f) The die ring 29 moves for cutting the billet 6, then the die cassette 35 moves for exchange of the die 4.

FIGS. 8(*a*) to 8(*f*) show the flow of operations when combining the method of the present invention of making the die ring 29 move vertically to cut the billet and the method of removing the discard 16 without using the main shear 26. FIGS. 8(*d*) and 8(*e*) are views of an extrusion press seen from above.

(a) A certain length of extruded material is extruded, then the extrusion is ended or interrupted to release the sealing pressure from the die 4.
(b) The die ring 29 is moved vertically to thereby simultaneously cut the billet 6 between the container 5 and die ring 29 and between the bolster 30 and the die ring 29.
(c) The extrusion is resumed.
(d) One billet 6 finishes being extruded.
(e) After the completion of the extrusion, the die 4 is moved horizontally to thereby simultaneously cut the billet 6 between the container 5 and die ring 29 and between the bolster 30 and the pressure ring 25. Simultaneously, the extrusion stem 7 advances and the discard 16 is pushed out.
(f) The die cassette 35 moves for cutting and exchange of the die 4.

In the above way, in the present invention, the billet 6 is cut between the die 4 and container 5, so only a short discard 16 remains inside the container 5. If the discard 16 is pushed out by the extrusion stem 7, the discard 16 can be easily removed, so the main shear 26 like in the prior art becomes unnecessary.

FIGS. 9(*a*) to 9(*f*) show the flow of operations when combining the method of the present invention of making the die 4 move horizontally to cut the billet and the method of removing the discard 16 without using the main shear 26. FIG. 9 except FIG. 9(*b*) is a view of an extrusion press seen from above. FIG. 9(*b*) includes the case of viewing from the side.

(a) A certain length of extruded material is extruded, then the extrusion is ended or interrupted to release the sealing pressure from the die 4.
(b) The die 4 is moved horizontally to thereby simultaneously cut the billet 6 between the container 5 and die 4 and between the pressure ring 25 and die 4.
(c) The die 4 is replaced or the same die 4 is used to resume extrusion.
(d) One billet finishes being extruded.
(e) After the completion of the extrusion, the die 4 is moved horizontally to thereby simultaneously cut the billet 6 between the container 5 and die 4 and between the pressure ring 25 and die 4. Simultaneously, the extrusion stem 7 advances and the discard 16 is pushed out.
(f) The die cassette 35 moves for exchange of the die 4.

In the above way, in the present invention, the billet 6 is cut between the die 4 and container 5, so only a short discard 16 remains inside the container 5. Therefore, if the discard 16 is pushed out by the extrusion stem 7, the discard 16 can be easily removed, so the main shear 26 like in the prior art becomes unnecessary.

Figure 10:
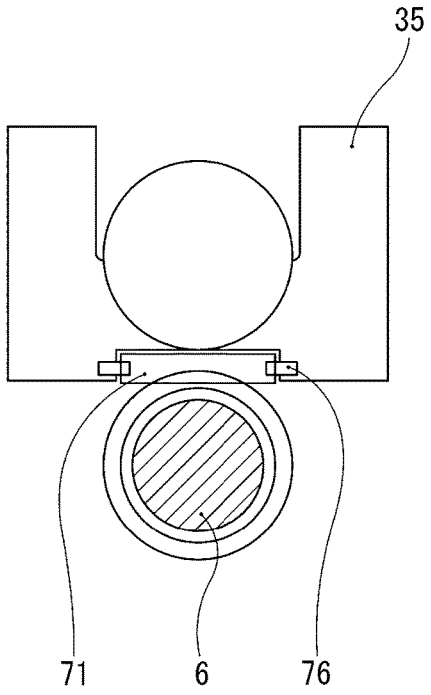
FIGS. 10(*a*) and 10(*b*) are view of attachment of a swingable shear knife to a die cassette of the present invention.
Figure 10:
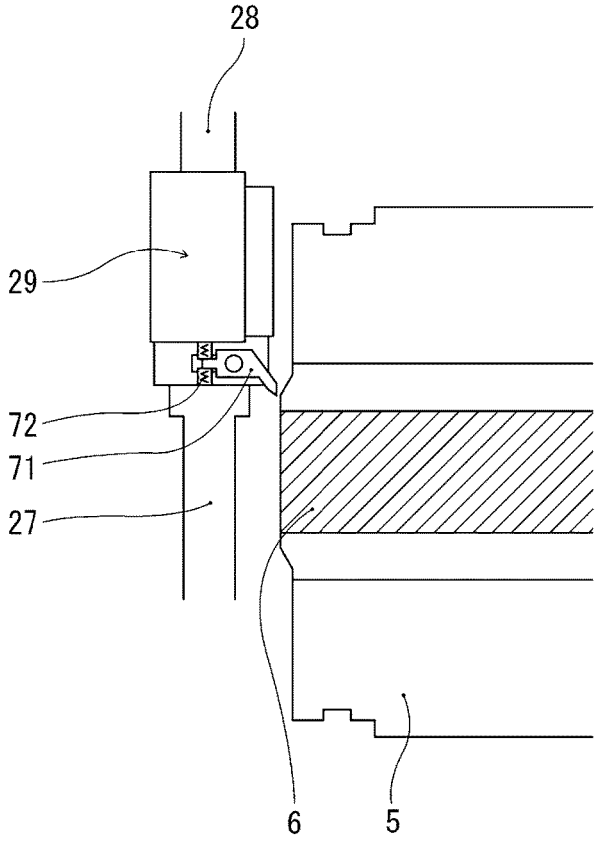

FIG. 10 is a view of a shear knife 71 attached to a die cassette. When cutting between the die 4 or die ring 29 and the container 7, metal deposits on the container 7 surface. The shear knife 71 supported at one end by the top and bottom springs 72 removes the deposited metal by swinging about the shaft 76. Similarly, when the die cassette moves horizontally as well, it is possible to arrange the shear knife 71 in the perpendicular direction so as to give the same function as the above.

(1) In the prior art, the billet was broken between the die and container after making the container retract, then the parts of the extruded material sticking out from the die and container were cut off by shear knives. Therefore, a long stroke was required for making the container and extrusion stem retract from the die. As opposed to this, the present invention is not configured to use shear knives for cutting, but just cuts the billet by the die or die ring, so the time is shortened and the productivity is improved.

(2) In the prior art, to cut off the billet, a die side shear knife and a container side shear knife were used to cut off parts and the die cassette was moved, so the part of the billet remaining inside the die slide ended up becoming scrap. As opposed to this, in the present invention, only an amount of the length of the die ring becomes scrap, so the yield ratio is improved. Furthermore, there is no end material of the aluminum material, so separation of the die ring and bolster is easy and die handling is easy.

(3) In the prior art, the billet was broken between the die and the container by making the container retract, so the fracture surfaces became distorted and even if parts were cut off by the shear knives, the billet did not become sufficiently flat. As a result, there was the possibility of blister-like shape forming at the next product. As opposed to this, in the present invention, the cut surfaces are clean, no blister-like form, and the quality is improved.

(4) In the prior art, the extruded material sticking out from the container side was pressed and compressed and the next die was exchanged with. At this time, the billet inside the container is formed in a state of work hardening, so does not easily become flat, so there was the possibility of blister-like shape forming at the next product. As opposed to this, in the present invention, the cut surfaces are clean, no blister-like form, and the quality is improved.

(5) In the present invention, the main shear which was attached in prior art for cutting the billet between the die and the container becomes unnecessary, so the cost of the installation members is reduced and simultaneously the facility becomes lower in height and space is saved. Further, the cycle time becomes shorter and maintenance is no longer required.

REFERENCE SIGNS LIST

1. end platen
2. main cylinder
3. tie rod
4. die
5. container
6. billet
7. extrusion stem
8. main crosshead
9. main ram
10. side cylinder
11. side cylinder rod
12. container holder
13. machine base
14. extruded material
15. container cylinder rod
16. discard
17. dummy block
20. container core holding device
21. taper seat
22. taper block
23. hydraulic cylinder
24. upper guide
25. pressure ring
26. main shear
27. die cutting cylinder
28. support
29. die ring
30. bolster
31. container key
32. container and die space positioning device
35. die cassette
36. die cutting block
37. die ring cutting block
38. die slide
39. die slide cylinder rod
60. container and die space positioning cylinder
61. container and die space positioning cylinder rod
62. shim
71. knife
72. spring
76. shaft
77. die slide gib

The invention claimed is:

1. An extrusion method using an extrusion press including an end platen to which a pressure ring is provided, a die, a container, a drive part for movement of the container, and a main cylinder device having an extrusion stem to form a billet into a shape, the method comprising:

extruding said billet loaded in said container by said extrusion stem from said die to shape it to an extruded material, releasing sealing pressure from said die, shearing said billet between said die and said container and between said die and said pressure ring by moving said die, and resuming shaping of extruded materials by the billet remaining inside said container, wherein a container core holding device is attached to an upper guide of said container so that the core of said container does not change when shearing said billet.

2. The method according to claim 1, further comprising exchanging said die, wherein said shearing is performed when a predetermined length of an extruded material is extruded, then said exchanging said die is performed.

3. The method according to claim 1, further comprising performing said shearing when extruded material leaks from the space between the die and container to the outside.

4. The method according to claim 3, wherein a swingable shear knife is attached to a die cassette of said die to contact an end surface of the container when shearing said billet in said shearing.

5. The method according to claim 1, comprising performing said shearing when extruded material sticks in the die.

6. The method according to claim 1, further comprising enabling positioning of a space between said container and said die when releasing said sealing pressure from said die and shearing the billet between said die and said container.

7. An extrusion method using an extrusion press including an end platen to which a pressure ring is provided, a die having a die ring and bolster, a container, a drive part for movement of the container, and a main cylinder device having an extrusion stem to form a billet into a shape, the method comprising:

extruding said billet loaded in said container by said extrusion stem from said die to shape it to an extruded material, releasing sealing pressure from said die, shearing said billet between said die ring and said container and between said die ring and said bolster, and resuming shaping of the extruded material by the billet remaining inside said container, wherein container core holding device is attached to an upper guide of said container so that the core of said container does not change when shearing said billet.

8. The method according to claim 7, further comprising exchanging said die, wherein said shearing is performed when a predetermined length of an extruded material is extruded, then said exchanging said die is performed.

9. The method according to claim 7, further comprising performing said shearing when extrusion material leaks from the space between the die and container to the outside.

10. The method according to claim 9, wherein a swingable shear knife is attached to a die cassette of said die to contact a container sealing surface when shearing said billet in said shearing.

11. The method according to claim 7, comprising performing said shearing when extrusion material sticks in the die.

12. The method according to claim 7, further comprising enabling positioning of a space between said container and said die when releasing said sealing pressure from said die and shearing the billet between said die and said container.

* * * * *